United States Patent [19]

Kloke

[11] Patent Number: 4,621,472

[45] Date of Patent: Nov. 11, 1986

[54] GLAZED STRUCTURAL SYSTEM AND COMPONENTS THEREFOR

[75] Inventor: Werner Kloke, Whitby, Canada

[73] Assignee: H. H. Robertson Company, Pittsburgh, Pa.

[21] Appl. No.: 689,347

[22] Filed: Jan. 7, 1985

Related U.S. Application Data

[63] Continuation of Ser. No. 431,047, Sep. 30, 1982, abandoned.

[51] Int. Cl.[4] ..... E04B 7/18

[52] U.S. Cl. ..... 52/397; 52/200

[58] Field of Search ..... 52/200, 397

[56] References Cited

U.S. PATENT DOCUMENTS

| | | | |
|---|---|---|---|
| 3,791,088 | 2/1974 | Sandow et al. | 52/200 |
| 3,844,087 | 10/1974 | Schultz et al. | 52/200 |
| 4,114,330 | 9/1978 | Sukolics | 52/200 |
| 4,194,325 | 3/1980 | Chalpin | 52/200 X |
| 4,455,798 | 6/1984 | Tsakiris | 52/200 |

*Primary Examiner*—J. Karl Bell

*Attorney, Agent, or Firm*—G. E. Manias

[57] ABSTRACT

Skylight structures or the like wherein the supporting and supported structural members defining the metal framework including flange formations upon which glass panels are secured are provided with longitudinally extending drainage channel formations and wherein the open ends of the drainage channel formations of the supported structural members intersect and overlap the drainage channel formations of the supporting structural members to the extent that water collected therein is discharged into the drainage channel formations of the supporting structural members at a point remote from the intersections thereof and wherein the structural members are interconnected by displaceable clamping means carried by said overlapping ends including a clip embracing same from below in the region of overlap and upon displacement upwardly engage the flange formations of the suporting structural members from below.

14 Claims, 9 Drawing Figures

GLAZED STRUCTURAL SYSTEM AND COMPONENTS THEREFOR

This application is a continuation of application Ser. No. 431,047, filed Sept. 30, 1982, and now abandoned.

FIELD OF THE INVENTION

This invention relates to improvements in glazed systems for use in industrial, commercial, institutional and residential buildings, and more particularly to improvements in the support structure derived from lengths of metal extrusions of aluminum or alloys thereof, assembled and connected together to provide an open framework for supporting and anchoring glass or other suitable panels or units thereupon to serve as a skylight or as cladding for a building or in solarium or greenhouse construction and in other similar installations.

More particularly, this invention relates to improvements in those mechanical connections to be established between the principal structural members comprising the framework that will accommodate requisite sealing along the intersections or lines of juncture thereof against penetration of atmosphere or of rainwater or other accumulations upon or draining into such framework.

BACKGROUND TO THE INVENTION

The introduction and wide acceptance of open concept architecture in recent years has given substantial impetus to the investigation and development of improved glazing systems derived from lengths of interconnected extruded metal members and sheets of glazing that not only will embody aesthetic and environmental considerations but more effectively utilize available natural light and solar energy.

Fundamental to the adoption and inclusion of skylights, cladding or other similar systems in building projects is the capability of the selected structure to meet principal objectives apart from those mentioned, such as to effectively limit heat or energy loss, maintenance of the integrity of the enclosed space so as to provide greater control of the interior atmosphere and to ensure stability of the system over a wide range of applied loading and temperatures imposed by the climate and by conditions prevailing within the building.

The development of improved systems has given rise to the desire to incorporate a greater expanse of glazed structure into buildings which must accommodate increased accumulations and increased loading and runoff and thereby increase the risk that the joints and other sealed connections of the expanded system will be penetrated by the atmosphere or by water.

OBJECTS OF THE INVENTION

The principal object of this invention therefore is to provide an improved glazing system that can be specified for all manner of installations and particularly where a wide unsupported expanse of same is required to be installed and wherein the likelihood of any penetration of the atmosphere or water through any mechanical joint or seal is then minimized thereby preserving both the integrity of the system itself as well as the environment within the building over an extended period of time.

It is a very important object of this invention to strengthen the structure by providing an improved mechanical connection between the components, which can accommodate to a greater degree twisting and deflection, expansion and contraction imparted by changes in external and internal conditions.

More particularly it is an object of this invention not only to simplify the manner in which the structural members are joined or connected together which gives rise to an increase in effeciency both in production and assembly but to include therewith more efficient barriers to the atmosphere, water or moisture in the region of the joints or connections.

FEATURES OF THE INVENTION

One principal feature of the invention resides in providing a supporting framework for a glazed system wherein the elongated structural members thereof include open ended drainage channel formations therein for the collection of water derived from rain, melted snow or condensed moisture and the controlled discharge of same therefrom without appreciable leakage throughout the extent of such framework by arranging that the open ends of the drainage channel formations of the structural members extending in one common direction intersect and overlap the drainage channel formations of the structural members extending in the other common direction whereby not only is the requisite support of the intersecting overlapping structural members achieved but that water collected in the drainage channel formations thereof is discharged therefrom at a point remote from the intersections with the supporting structural members.

More particularly it is a feature of the invention to provide a building system wherein the supporting structural member includes a longitudinally extending channel defined by a bottom wall, upstanding spaced apart side walls and a flange formation extending inwardly from at least one of the side walls in overlying spaced relation above the bottom wall and includes a recess within the side wall and associated flange formation which is spaced upwardly from the bottom wall thereof and has a configuration to receive therein one end of the supported structural member in overlapping relation thereto and in full registration with the recess so as to be supported therefrom but above the bottom wall thereof.

It is another feature of this invention to provide a novel clip for securing the supported structural member to the supporting structural member which clip is disposed within the channel formation of the supporting structural member and has a configuration so matching the perimeter of the recess therein and the overlapping end of the supported structural member as to embracingly engage same from below. The clip extending beyond the recess to engage the flange formation of the supporting structural member from below upon upward displacement thereof into embracing engagement with the overlapping end of the supported structural member, the overlapping end of the supported structural member carrying screw threaded members for engaging and drawing the clip upwardly thereagainst and into engagement with the flange formation of the supporting structural member whereby a secure mechanical connection is achieved.

Still another feature resides in providing a resilient bond substantially impervious to the atmosphere and to water between the opposed surfaces of the clip and recess and the overlapping end of the supported structural member when fully registered therewithin and secured against separation so as to minimize if not eliminate any penetration of the atmosphere or water through such connection.

More particularly a feature of the invention resides in providing a mechanical connection wherein there is no penetration of the bottom wall of the channel formation of the supporting or supported structural member in a region which would communicate with the interior of the enclosed space, thereby preserving the integrity of the barrier to the outer atmosphere throughout its extent.

Still more particularly a feature of this invention resides in providing a clip for the mechanical connection can be appropriately dimensioned to provide a substantial surface of contact with the overlapping end of the supported structural member thereby extending if desired the area for establishing a resilient bond thereto so as to ensure that the barrier to the penetration of either the atmosphere or water is maintained.

These and other objects and featurs are to be found in the following description of the preferred embodiment of the invention to be read in conjunction with the sheets of drawings wherein.

Figure 1:
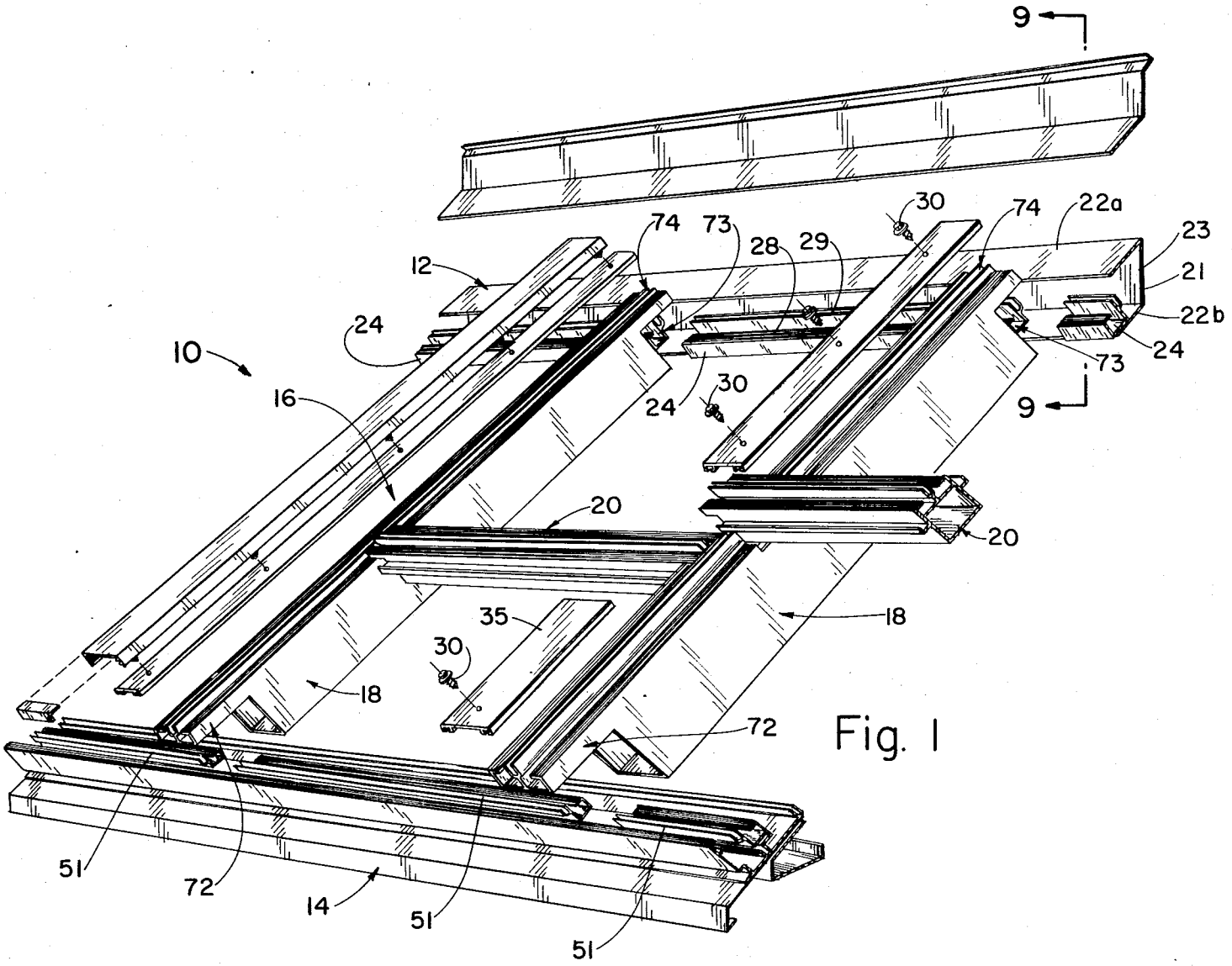
FIG. 1 is a perspective view of a section of an inclined support system for glazing derived from metal components embodying the invention partly broken away and partly exploded to reveal generally how the structural components thereof intersect and the relationships thereof.
Figure 7:
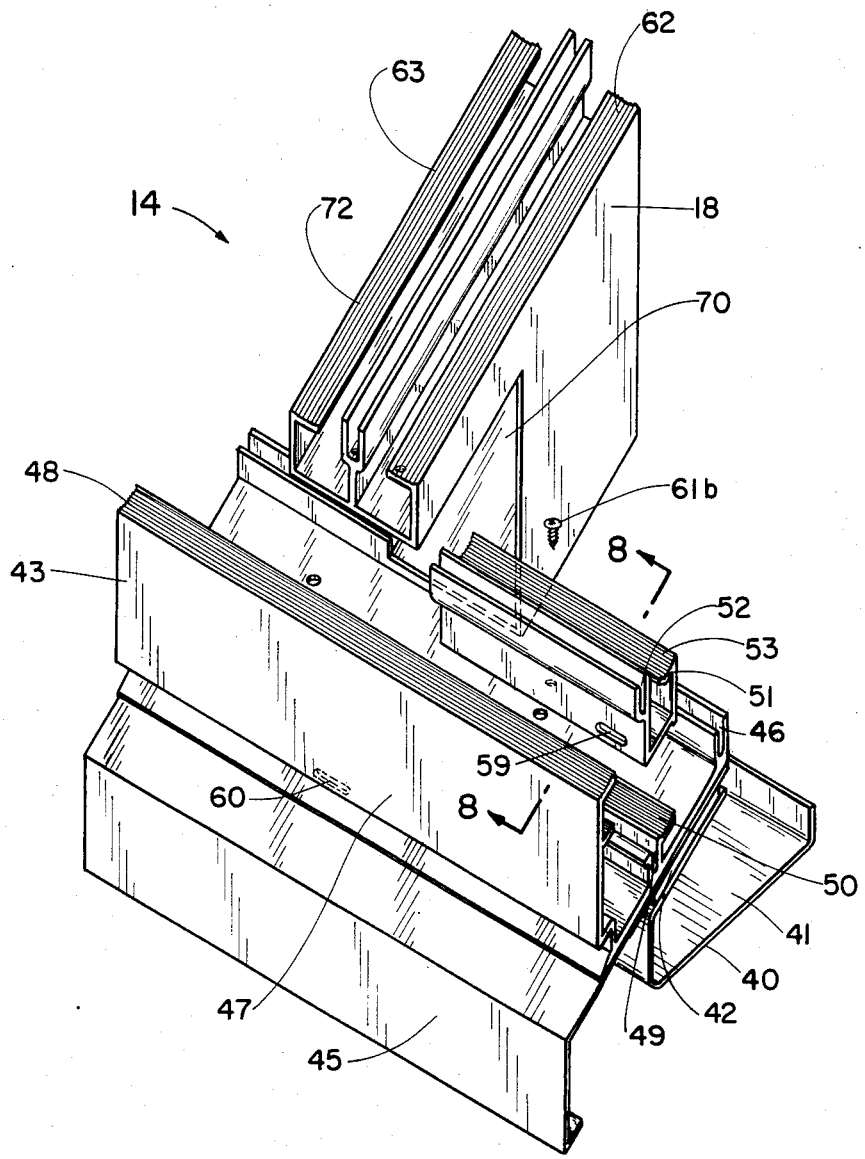
FIG. 7 is an enlarged perspective view of a section of the sill construction for the inclined glazing system illustrated in FIG. 1, partly broken away and partly exploded to reveal how the sill components intersect and the relationships thereof.
Figure 8:
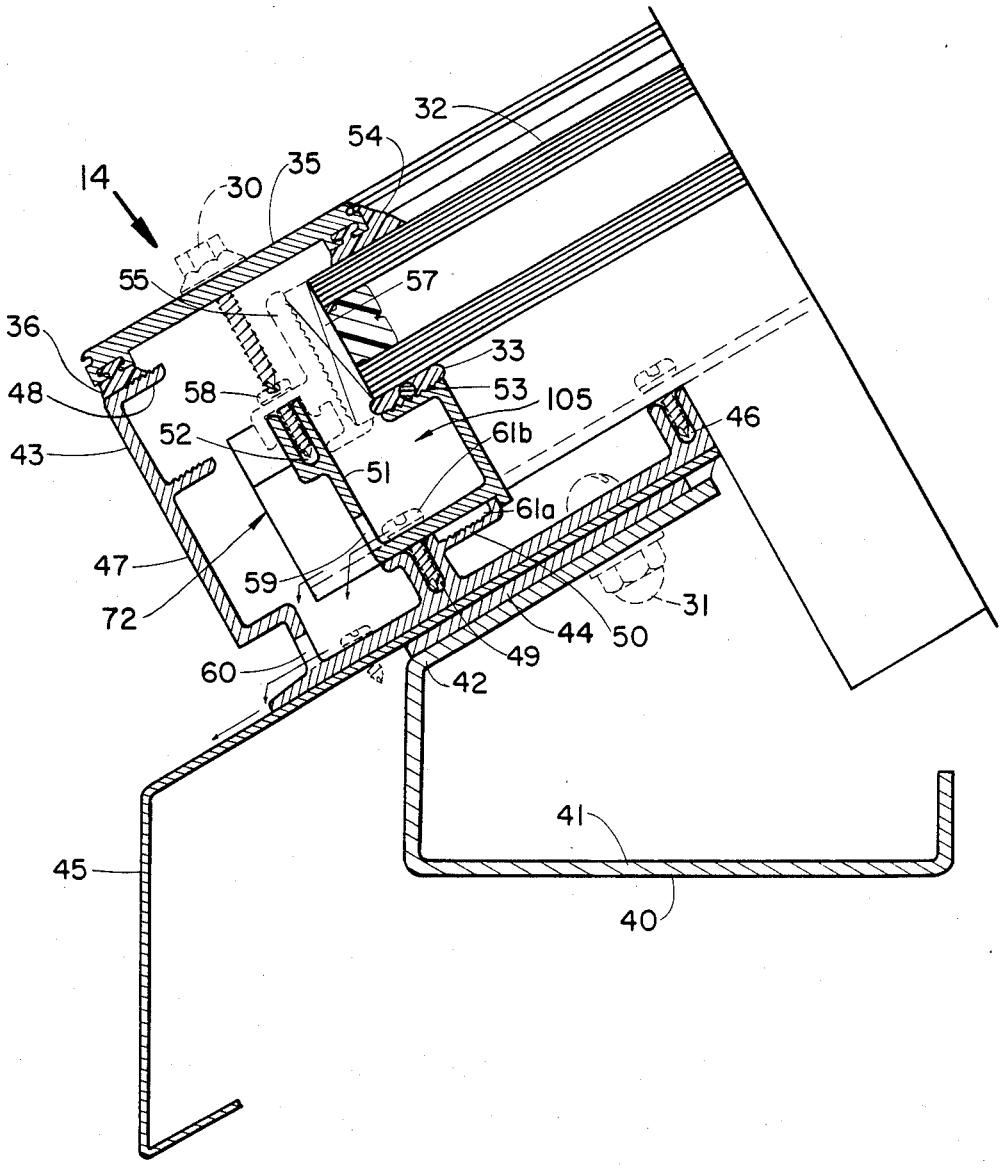
Figure 9:
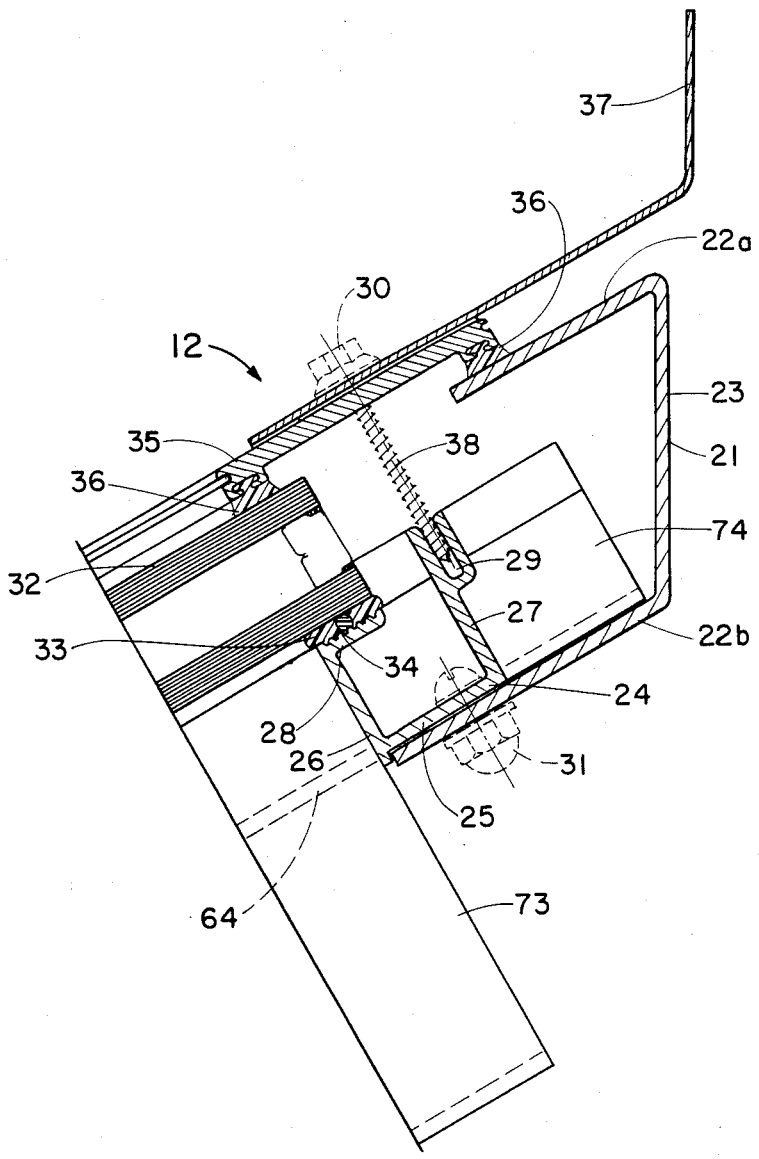

FIG. 8 is an enlarged vertical cross-sectional view of the fully assembled sill structure of the inclined system of FIGS. 1 and 7, partly broken away and taken along the lines 8—8 of FIG. 7, FIG. 9 is an enlarged vertical cross-sectional view of the assembled head structure of the inclined glazing system illustrated in FIG. 1, also partly broken away and taken along the lines 9—9 of FIG. 1.

THE GLAZED SYSTEM

A support system 10 for carrying glass panels or the like embodying the invention and illustrated by the perspective exploded view of FIG. 1 is comprised essentially of a head structure 12 for securing the system at its uppermost limit to a beam or abutment surface or wall of a building, a sill structure 14 for anchoring the system at its lowermost limit to the foundation or to an abutment surface or wall of a building, and a framework 16 extending between the head structure 12 and sill structure 14 comprised of vertically inclined rafters 18 uniformly spaced apart and horizontally extending uniformly spaced apart purlin members 20 intersecting with rafters 18.

Head structure 12, sill structure 14 and framework 16 are securely fastened together where the components thereof intersect to provide a uniformly inclined resilient framework for supporting suitable glass panels or other selected units in a manner which establishes a substantially impervious seal to the atmosphere to water and to water vapour.

Those components of the invention which fulfill the same function in the preferred embodiment to be described are identified hereinafter by identical numbers, where appropriate.

THE HEAD STRUCTURE 12

Head structure 12 of FIG. 1, more particularly detailed in FIG. 9, is comprised of a main structural support member 21 derived from a suitably formed sheet of aluminum or alloy thereof so as to present a pair of spaced, inclined arm portions **22*a*, 22*b* and a base portion 23, which base portion 23** is arranged to extend along the vertical facing of a supporting beam or abutment and be anchored thereto in any suitable manner.

Mounted upon inclined lower arm portion **22*b* of structural member 21 to extend upwardly thereform is a supporting structural member 24 of extruded aluminum or alloy thereof in a shape to present a base 25 with two spaced upstanding arms 26 and 27, arm 26 presenting an elongated flange or platform formation 28 uppermost and arm 27 presenting an elongated upwardly opening U-shaped anchoring channel formation 29 uppermost for the reception and anchoring of the threaded shafts of pressure plate compression screws 30 as as shown in broken outline in FIG. 9**.

Supporting and clamping member 24 is suitably anchored to the lower arm **22*b* of structural support member 21 by shear transfer bolts 31 shown in broken outline in FIG. 9** or other suitable fasteners at requisite spaced intervals.

According to the preferred embodiment of the invention illustrated, double glazed window units 32 are adapted to be mounted within the supporting framework 16 bounded by head structure 12 and sill structure 14, and in the case of supporting structural member 24 of head structure 12, as illustrated in detail in FIG. 9, the uppermost edge portion of double glazed window unit 32 is supported from the flange or platform formation 28 upon a main seal component 33.

More particularly the upper surface of flange or platform formation 28 is uniformly serrated longitudinally as at 34 so as to provide a positive grip and maintain main seal component 33 in place under the load applied thereto by the overlying or double glazed window unit 32 which is secured against separation from such main seal component 33 by means of pressure plate 35 and associated compressible dry seal elements 36 under the clamping pressure exerted by pressure plate compression screw 30 and by other peripherally located like presure plates and associated dry seal elements to be described.

It will be observed that dry seal elements 36 carried by pressure plate 35 along each edge thereof within anchoring channels therefore are arranged to bear upon the upper surface of the inclined arm portion **22*a* of structural support member 21 and upon the upper surface of double glazed window unit 32 respectively, the pressure plate 35 being arranged to underlie flashing 37 with the presure plate 35 and flashing 37 being apertured so as to allow penetration of the threaded shaft 38 of pressure plate compression screws 30 therethrough and engage the inner walls of U-shaped anchoring channel formation 29, all as illustrated in FIG. 9** thereby securing the components against separation.

Main seal component 33 located interiorally of the glazed window unit 32 in the preferred embodiment takes the form of a length of extruded polyisolbutylene semiliquid seal with an embedded continuous neoprene shim. With this arrangement a substituted barrier to the penetration of the atmosphere, water and water vapour between window unit 32 and platform formation 28 is established.

Dry seal components 36 are preferably extruded EPDM 60 durometer which key into the aforementioned channel formation presented by aluminum pressure plate 35 at each wedge thereof and are held under constant compression of the order of 10 PSI by pressure plate compression screws 30. Compression screws 30 are preferably seal-sealing plated steel screws with a self-tapping point capped with a suitable plastic.

SILL STRUCTURE 14

Sill structure 14 illustrated in FIGS. 1, 7 and 8 comprises a base structural support member 40 derived preferably from a suitably formed sheet of aluminum or alloy thereof and includes a base portion 41 and upstanding inclined support portion 42 for supporting and securing extruded aluminum sill member 43 thereto by means of shear transfer bolts 31 but structural support member 40 is separated from extruded sill member 43 by a suitable thermal insulator 44 and shielded by a length of flashing 45.

Extruded aluminum sill member 43 is provided with an upwardly opening U-shaped anchoring channel formation 46 along its upper inner edge as depicted in FIG. 8 and an upstanding bounding wall formation 47 along the lower, outer edge thereof, the latter wall formation 47 presenting a flange or platform formation 48 uppermost suitably serrated longitudinally to provide a gripping surface for a dry seal component 36 of a suitable section of overlying pressure plate 35 to be clamped in position.

A second upwardly opening U-shaped anchoring channel formation 49 is presented by extruded sill member 43 upstanding from the base portion thereof between inner U-shaped anchoring channel 46 and outer upstanding wall formation 47 thereof and including an associated flange or platform formation 50 extending inwardly therefrom upon which an extruded aluminum glass supporting structural member 51 is mounted, which member 51 preferably has a configuration and dimensions in cross-section corresponding to extruded aluminum supporting structural member 24 of head structure 12.

Supporting structural member 51 likewise presents an upwardly opening U-shaped anchoring channel formation 52 along its lower, outer edge and a flange or platform formation 53 along its inner upper edge which flange formation 53 is longitudinally serrated and adapted to support a length of the main seal component 33 upon which the lower edge portion of double glazed window unit 32 bears with the double glazed window unit 32 being clamped against separation under the clamping force applied by the aforementioned length of pressure plate 35 and associated compressible seals, a dry seal component 36 as earlier mentioned and a ramp seal 54 replacing the dry seal component 36 in this embodiment for sealing against the lower edge of window unit 32.

Extruded aluminum supporting structural member 51 is also adapted as illustrated to support the double glazed window unit 32 against downward sliding movement by the provision of an upstanding barrier 55 shown in broken outline which hooks over U-shaped channel formation 52 of clamping member 51 and presents a recess formation 56 opening inwardly and upwardly in spaced relation to the lower end of double glazed window unit 32 to receive and retain therebetween a suitable setting block 57 also shown in broken outline which bears against and prevents the lower edge of the double glazed window unit 32 from displacement downwardly.

Barrier 55 can be secured in place by suitable assembly screws 58 which are adapted to enter within U-shaped anchoring channel 52 all as illustrated in FIG. 8.

Both extruded aluminum supporting structural member 51 and the extruded sill member 43 are provided with drainage openings 59 and 60 therein respectively which serve to drain or discharge moisture or water collecting in the interconnected drainage channel system of the inclined framework 16 as will be more particularly described as well as to establish communication between such drainage channel system and the atmosphere so that any pressure buildup from water vapour is avoided.

An appropriate sealant 61a such as liquid butyl is deposited within the confines of flange formation 50 which together with an assembly screw **61*b* securing supporting structural member 51 to the extruded sill member 43** establishes an inner barrier to the penetration of the atmosphere or of water or water vapour.

FRAMEWORK 16

Framework 16 of the inclined glazed system 10 embodying the invention includes rafters 18 which extend upwardly and at a uniform angle between sill structure 14 and head structure 12.

Rafters 18 according to the preferred embodiment illustrated in FIGS. 1 to 4 inclusive are derived from a suitable aluminum extrusion or an alloy thereof and have a tubular configuration or hollow construction as depicted in FIGS. 2, 3, 4 and 6.

Alternative rafter configurations are also appropriate, for example the I shape.

Rafters 18 preferably have a maximum strength to weight ratio and can be provided over a range of depths as may be required.

Rafters 18 of tubular or I shape configuration can be combined if desired in order to meet objectives in any particular setting.

Rafters 18 include a pair of spaced apart walls **71*a*, 71*b* terminated in inwardly extending opposed flange or platform formations 62 and 63 upstanding from the edges of principal wall 64 thereof and overlying same platform formations 62, 63 being longitudinally serrated as at 65 and 66 so as to provide gripping surfaces for retaining longitudinally extending strips of the main seal component 33 against which the respective side edges of the double glazed window units 32** are to be clamped.

Upstanding centrally from wall portion 64 between flange formations 62 and 63 is a upwardly opening U-shaped anchoring channel formation 67 adapted to receive the threaded shafts 38 of pressure plate compression screws 30 all in a manner as earlier described in connection with the components comprising head structure 12 and sill structure 14.

The configuration of opposite symmetry of upstanding flange formations 62 and 63 separated by U-shaped channel formation 67 define with the wall portion 64 of rafter 18 a pair of open ended drainage channel formations 68 and 69 which extend uninterruptedly throughout the length of rafter 18 from head structure 12 to the sill structure 14 and with openings thereinto extending longitudinally therealong which constitute the main drainage passages.

As illustrated in FIGS. 7 and 8 particularly at the intersection of rafter 18 with sill structure 14, rafter 18 is cut away or recessed as at 70 below the principal upper wall portion 64 to thereby present to sill structure 14 a projecting portion 72 which is adapted to overlie extruded sill member 43 and terminate inwardly of upstanding wall formation 47 whereby any drainage is discharged below the juncture or rafter 18 with sill member 43.

Extruded aluminum supporting structural members 51 of the sill structure 14 are dimensioned such that they extend between the projecting portions 72 of rafters 18 with the ends of such members 51 abutting the outer surfaces of flange formations 62 and 63 of projecting portions 72 and rafter 18 respectively.

Flange formations 53 of extruded supporting structural member 51 are appropriately dimensioned and arranged so as to register with opposed flange formations 62 and 63 of rafter 18 respectively whereby the serrated gripping surfaces thereof for main seal component 33 are disposed in substantially coplanar relation.

Likewise in relation to head structure 12 the upper ends of rafters 18 are recessed as at 73 below the principal upper wall portions 64 thereof to provide upper projecting portions 74 which overlap the upper surface of the lower arm portion 22*b*of main structural support member 21 and anchored thereto by means of shear transfer bolts 31.

Likewise the ends of supporting structural members 24 of head structure 12 abut the outer surfaces of the projecting portions 74 of rafters 18 the dimensioning of the supporting structural members 24 likewise being selected and the components arranged so that the flange formations 28 thereof register with the opposed platform formations 62 and 63 of rafters 18. Thus the serrated surfaces of the respective flange formations are disposed in substantially coplanar relation for the reception of the lengths of the main seal components 33 to provide a perimetral barrier therearound when a double glazed window unit 32 is clamped into position thereupon.

It will be observed from FIG. 1 that purlins 20 of the framework 16 intersect with rafters 18 at intervals.

Purlins 20 are likewise preferably derived from an aluminum extrusion or alloy thereof.

Figure 5:
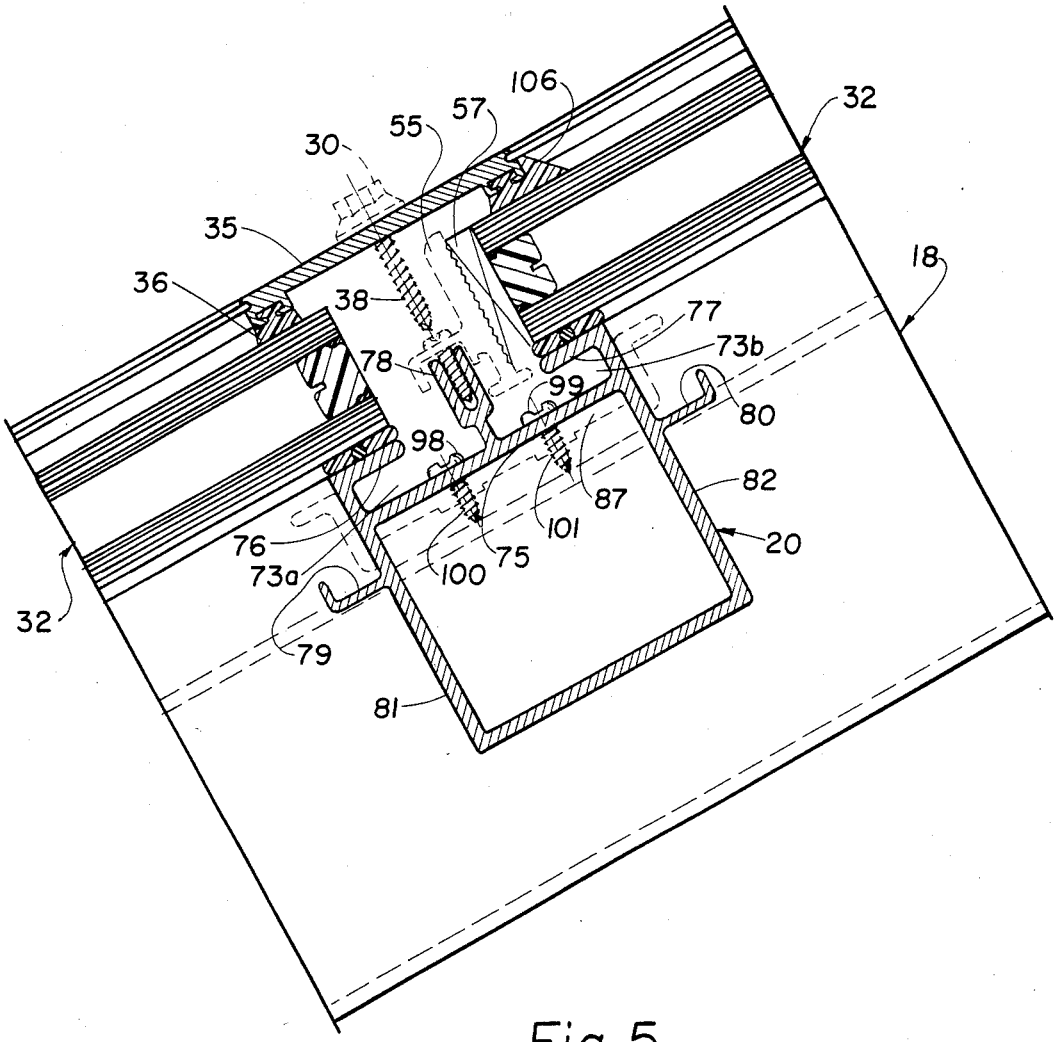
FIG. 5 is a vertical cross-sectional view of the connected rafter and purlins illustrated in FIGS. 1 and 2 and taken along the lines 5—5 of FIG. 2.

According to the preferred embodiment as particularly illustrated in FIG. 5 purlins 20 have a tubular or hollow construction with the principal wall portion 75 thereof presenting spaced apart upwardly extending walls terminating in inwardly extending opposed flange or platform formations 76 and 77 respectively located above wall portion 75 thereby defining a pair of channel formations as at 73*a* 73*b*.

Opposed flange formations 76 and 77 are separated by a centrally located upwardly extending U-shaped anchoring channel formation 78 which is adapted to cooperate with the threaded shafts 38 of the pressure plate compression screws 30, all in a manner earlier explained in connection with the head structure 12 and sill structure 14.

Purlins 20 in addition are provided with condensation channel formations 79 and 80 extending outwardly from the opposed wall portions 81 and 82 thereof to trap any moisture condensed on the surfaces of the purlins or on the inner surfaces of the double glazed window units 32 next to the main seal connection established therebetween.

Figure 6:
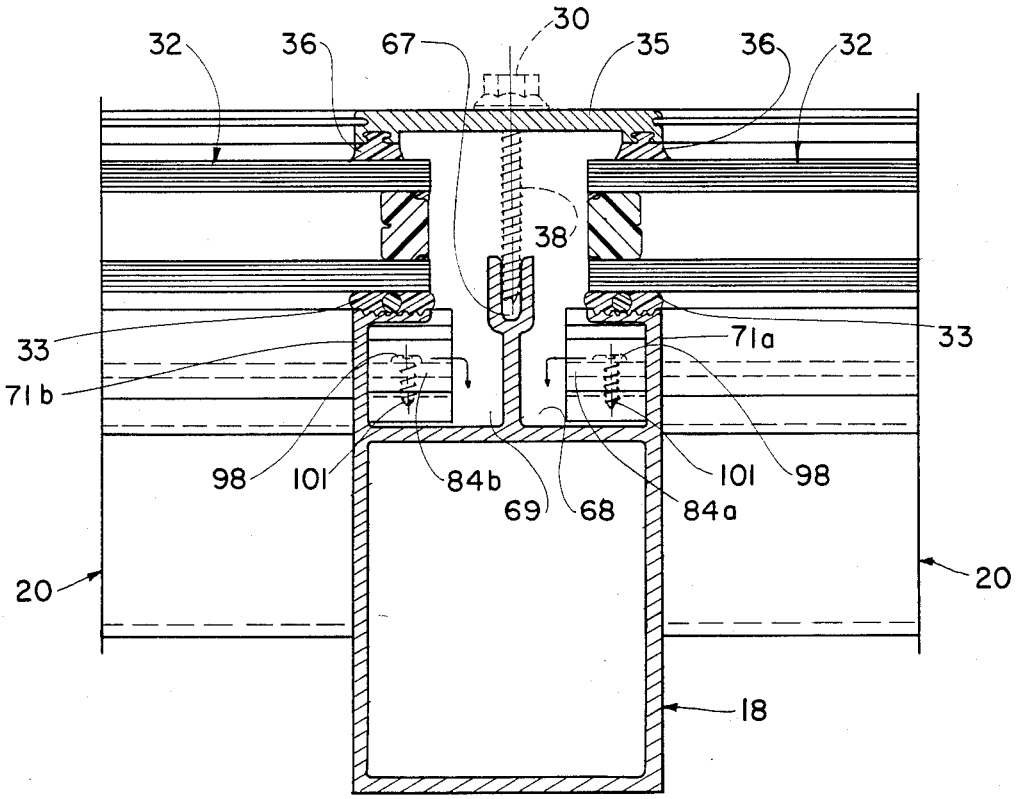
FIG. 6 is a vertical cross-sectional view of the connected rafter and purlins illustrated in FIGS. 2 and 5 taken along the lines 6—6 of FIG. 5.

According to the invention the ends of purlins 20 are cut away as at 83*a* and 83*b* respectively below the principal wall portion 75 thereof and thereby present projection portion 84*a* and 84*b* at each end which as illustrated in FIG. 6 are adapted to overlap thejuncture with rafters 18 and discharge any water or condensed water vapour collected therein into drainage channel formations 68 and 69 respectively of the rafter 18 inwardly of the aforementioned intersection.

Projection portions 84*a* and 84*b* are adapted to register within opposed recesses or openings 85 and 86 respectively formed in opposed wall and flange or platform formations 62, 63 of rafter 18, which recesses 85 and 86 have a perimeter matching the perimeter of projection portions 84*a*, 84*b* of purlins 20 registered therewith.

This arrangement ensures that a substantially rigid connection between rafters 18 and purlins 20 in a direction longitudinally of the rafter 18 and preserves the seal to be established therebetween as will be described.

Underlying each of projection portions 84*a*, 84*b* of purlin 20 and located within each drainage channel formation 68, 69 respectively of rafter 18 are like separable metal novel clips 87 derived from a length of suitable aluminum extrusion or alloy thereof.

Figure 4:
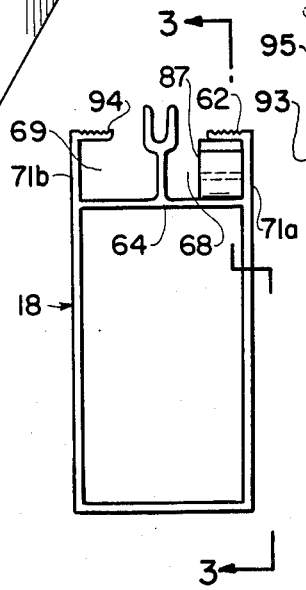
FIG. 4 is a vertical cross-sectional view of the rafter illustrated in FIGS. 1 and 2 taken along the line 4—4 of FIG. 2.
Figure 3:
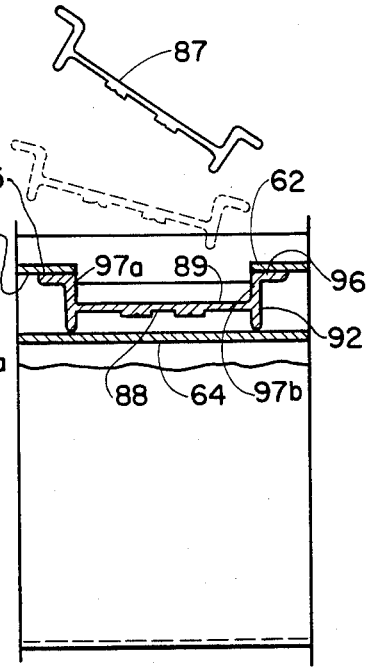
FIG. 3 is a cross-sectional view taken along the line 3—3 of FIG. 4 showing the manner of inserting and positioning the clip within a rafter for connecting the purlin to the rafter.

Clips 87 each include a central platform portion or web 88 as best seen in FIGS. 3 and 4 flanked by a pair of upstanding wall portions 90 and 92, legs 90 and 92 having an extent such that the central platform formation or web 88 is supported slightly above the main wall portion 64 of rafter 18 and bridge the separation between such main wall portion 64 and the undersurfaces 93 94 of the respective flange formations 62, 63 of rafter 18 next adjacent recesses 85, 86.

Wall portions 90 92 terminate uppermost in wing-like extensions 95 96 respectively, which project form wall portions 90, 92 in opposed directions to lie next below undersurfaces 93 94 of the respective flange formations 62 63 next adjacent openings 85 86.

Clips 87 are dimensioned so that the upper surface 89 of central platform formation 88 thereof and the inner surfaces 97*a* 97*b* respectively of wall portions 90, 92 will register with and match the outline or perimeter of the recesses 85, 86 of each of the respective flange formations 62 63 and form an inward extension thereof thus together with the perimeter of recesses 85 86 both embracing and supporting the projecting portions 84*a* 84*b* of the intersecting purlins 20 therewithin respectively.

Figure 2:
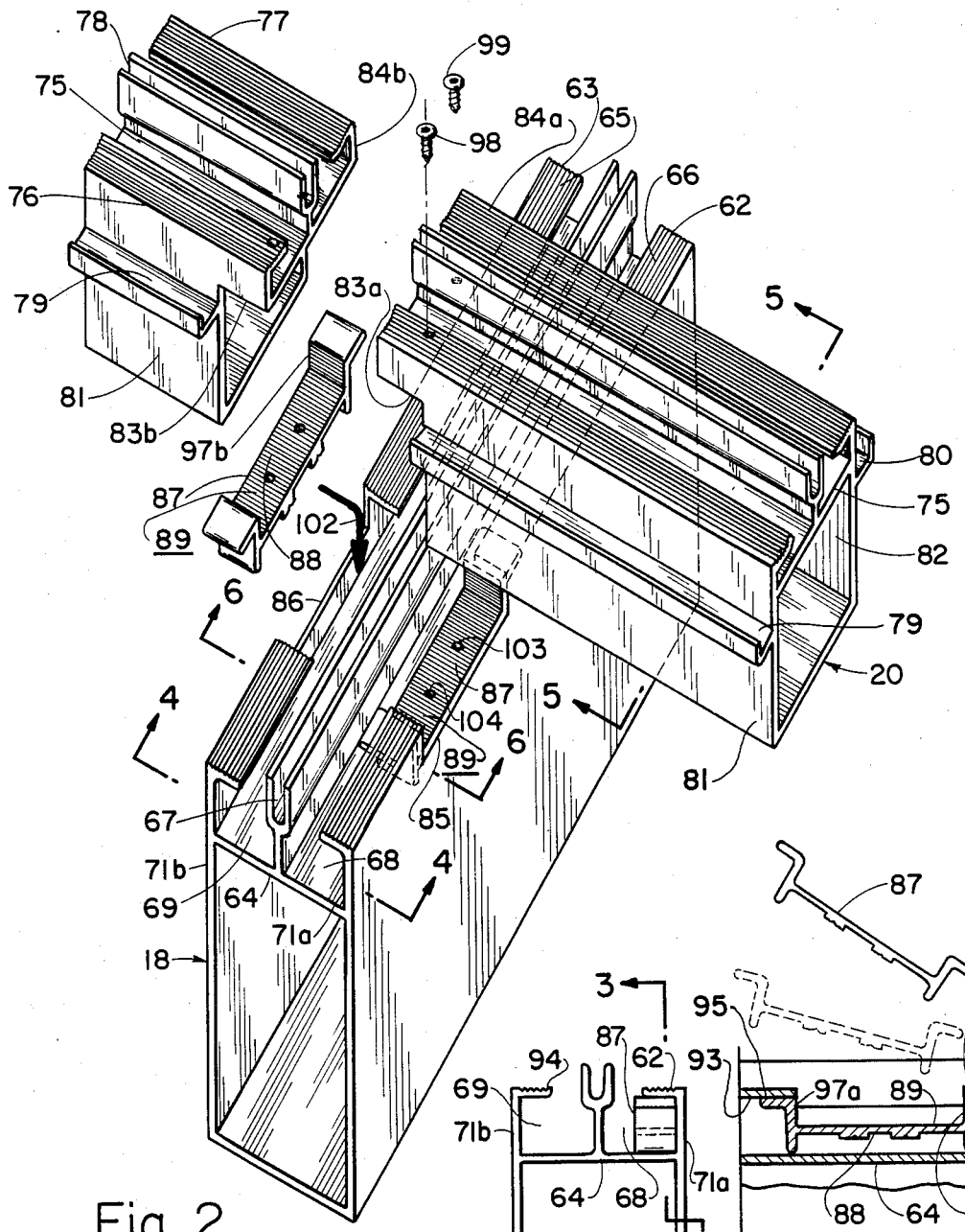
FIG. 2 is an enlarged perspective view of one of the principal connection between rafter and purlins as illustrated in FIG. 1, partly broken away and partly exploded to reveal particularly how the components are joined together.

Upper surface 89 of central platform formation 88 of clip 87 and the surfaces 97*a*, 97*b* of the legs 90, 92 thereon are suitably serrated as illustrated in FIG. 2 so as to provide an extended gripping surface to a selected sealant such as liquid butyl to bond with and effectively seal the separation between rafters 18 and purlin 20 under clamped engagement therebetween.

The particular connection between rafter and purlin so described is adapted to be achieved by means of assembly screws 98 99 which penetrate that portion of the wall 75 or purlin 20 lying within the extent of the projecting portions 84*a* and 84*b* thereof beyond the line of juncture or intersection betwen purlin and rafter.

The threaded shafts 100, 101 of assembly screws 98, 99 register within apertures 103, 104 presented by platform formation 88 of clips 87 and draw clips 87 upwardly and force projecting portions 84*a*, 84*b* of purlins 20 downwardly to achieve tight clamping engagement between upper surfaces 89 of central platform formations 88 and the lower surfaces of the principal upper wall portion 75 and the surfaces of the side wall portions 81, 82 of the projecting portions 84*a*, 84*b* of purlins 20 to which the aforementioned sealant has been adhered.

This clamping action exerted by the assembly screws 98 99 in establishing a connection between purlins 20 and clips 87 urges the wing extensions 95 96 of clips 87 into engagement with the undersurfaces 93, 94 of the respective flange formations 62 63 of rafter 18 thereby resiliently anchoring purlins 20 to rafter 18 and notably without the threaded shafts 100 and 101 of assembly screws 98, 99 penetrating the principal upper wall portion 64 of rafter 18.

Accordingly in so far as framework 16 is concerned there is no breach by an assembly screw or other fastener of any principal wall portion 64 of rafter 18 which serves as the bottom wall for drainage channels 68, 69 or any principal wall portion 75 of purlin 20 which serves as the bottom wall for drainage channels 73*a*, 73*b* in any region except where the projecting portions 72 and 74 of the rafter 18 overlap the supporting structural support member of the head structure 12 or sill structure 14 or except where the projecting portions 84*a*, 84*b* of the purlins 20 overlap the drainage channel formations 68, 69 of rafters 18. Thus the integrity of the metal barrier constituted by structural members is preserved.

One of the clips 87 illustrated in FIG. 2 of the drawings is shown in place immediately prior to being clamped by assembly screws 98, 99 to purlin projecting portion 84*a*. The relationship established between inserted clip 87 and upstanding flange formation 62 with clip 87 in place is illustrated by FIG. 4 of the drawings.

The other clip 87 illustrated in FIG. 2 which is likewise adapted to secure and anchor purlin projecting portion 84*b* to rafter 18 is shown in a position above the opening 86 with an arrow 102 indicating the direction of inserting such clip 87 within such opening 86 and below the adjacent ends of flange formation 63 presented to recess 86.

More particularly in FIG. 3 the manner of inserting clip 87 within the drainage channel formations of the rafter 18 to register with the openings 85, 86 is shown in stages by means of solid and broken outline whereby clip 87 is ultimately seated in full registration with the opening 86.

The preferred sealant liqud butyl which is applied and spread over the upper serrated surfaces 89 of central platform formation 88 and surfaces 95, 96 of wall portions 90, 92 of clips 87 as well as over the edges of the respective recesses 85, 86 in rafter 18 and over the mating surfaces of the projecting portions 84*a*, 84*b* of purlins 20 is cured filling up any separation therebetween and establishing a strong resilient bond between opposed surfaces thereby ensuring that a substantially permanent barrier will persist minimizing if not eliminating penetrating of atmosphere water or water vapour from the drainage channels 68, 69 of the rafters 18 to the space enclosed by the glazed system.

It will be understood that this resilient connection derived by clamping purlins 20 to rafters 18 in the manner outlined creates a resilient bonding along with a mechanical connection that is derived from clamping engagement as opposed to direct attachment of purlin to rafter by a bracket and threaded fasteners. This connection or joint will withstand the loading generated by the expansion and contraction of the components over a wide range of temperatures and deformation to which the structure is subjected by climate interior heating and forces generated by the wind or by rainwater or under accumulations of snow or ice.

It is also to be observed that purlins 20 of framework 16 are appropriately dimensioned so as to present to flange formations 62, 63 or rafters 18 the opposed purlin flange formations 76, 77 as particularly illustrated in FIGS. 5 and 6 thus establishing the substantially coplanar relationship to support the lengths of the main seal component 33 which underlie the edges of the double glazed window units 32 and provide a continuous main peripheral seal 33 peripherally below such window units.

More particularly, it is to be observed that the opposed purlin flange formations 76, 77 together with purlin upper wall 75 and centrally located and upstanding U-shaped anchoring channel 78 define a pair of drainage channels 73*a* and 73*b* for collecting and discharging rainwater or condensed water vapour to the drainage channel formations 68 and 69 of rafters 18.

FIG. 6 of the drawings shows that the open ends of purlin projecting portions 84*a*, 84*b* are spaced from the central upstanding U-shaped anchoring channel formation 67 of rafter 18 so that drainage from channel formations 73*a* and 73*b* is unobstructed for the ready discharge or accumulated runoff or condensed vapour.

System 10 established by the intersecting interconnected rafters 18 and purlins 20 appropriately anchored and completed by head structure 12 and the sill structure 14 as outlined provide the requisite uninterrupted perimetral support for double glazed window units 32 clamped in place sealed outermost under the clamping pressure exerted by pressure plates 35 and pressure plate compression screws 30 and associated dry seals 33 and ramp seals 54 against the outer surface of window units 32 constituting a first barrier to the penetration of the atmosphere or rainwater.

Each such clamped window unit 32 supported upon framework 16 is bounded by an interior peripheral drainage channel formation comprised of drainage channels 68 or 69 of rafters 18 or drainage channels 73*a* and 73*b* of purlins 20 and lowermost by the channels 105 defined within extruded supporting structural members 51 of sill structure 14.

Any rainwater or melted snow or ice penetrating the seals of pressure plates 35 or water vapour condensing within the interior drainage channels will be directed to the sill structure and ultimately discharged to the atmosphere through drainage openings 59 and 60.

It is essential in the mounting of the double glazed window units 32 within the supporting framework 16 that appropriate double glazing supports in the form of an upstanding barrier 55 and setting blocks 57 be installed where necessary as shown in broken outline in FIG. 5, which arrangement corresponds to that employed in the sill structure 14.

Further it is to be understood that in the case of the seals associated with the pressure plate sections 35 which are to be secured to purlins 20 the upper seals are preferably ramp seals as indicated at 106 in FIG. 5. The ramp seal 106 of FIG. 5 and ramp seal 54 of FIG. 8 provide a greater surface of gripping contact and thereby tend to preserve the integrity of the connection as well as better deflect any descending rainwater or accumulations of snow or ice lodged on the exterior surface.

It will be understood that the intersecting pressure plates 35 are suitably cut and placed to overlie and isolate from the exterior the entire drainage channel system by means of associated seals 33 and ramp seals 54 and 106 and are to be maintained under a clamping pressure of the order of 10 PSI against the perimeters of the double glazed window units 32 to preserve the connection.

With such an arrangement the major proportion of the components of the metal framework 16, the head structure 12 and the sill structure 14 are likewise isolated from the exterior atmosphere with the practical result that a maximum metal surface is exposed to the temperature of the interior with the minimum metal surface exposed to the exterior. Thus such an arrangement minimizes heat transfer to and from the interior or enclosed space and brings the control of the interior atmosphere within better defined limits.

The second barrier to penetration is constituted by the interior drainage channel system which include the downsloped overlapping projection portions of the respective purlin and rafters all exteriorally located of the main seal components 33 and therebetween thereby miminizing the likelihood of penetration of the atmosphere or water into the enclosed interior space and thereby preserving its integrity.

Finally by reason of the novel clamping interlock between rafter 18 and purlins 20 by means of the clip 87 and associated assembly screws and the resilient bond established therebetween by the confined sealant a flexible connection or joint capable of accomodating loading due to expansion and contraction over a wide range of temperatures and applied forces is achieved while any penetration therebetween is blocked.

It will be understood that this invention gives rise to the ready provision of a much greater expanse of substantially impenetrable glazed structure than heretofore contemplated and thereby extends the boundries of open concept architecture.

The framework 16 can be supported along the sides thereof between the head structure 12 and sill structure 14 by a variety of structural alternatives derived from formed aluminum sheeting anchored to suitable supporting members or walls in a manner similar to that illustrated in connection with the head structure or to adjacent like glazed frameworks as for example angled to one another in multifaceted skylight construction.

Modified shapes or configurations of rafters 18 and purlins 20 may be substituted for these illustrated to provide a domelike or barrel vault structure according to specification.

Single glazing or triple glazing may be substituted for double glazing.

It will be understood therefore that it is intended that changes can be made in the preferred embodiment described and illustrated herein by those persons skilled in this field without departing from the spirit and scope of the invention as defined in the appended claims.

What I claim is:

1. In a roof structure, a plurality of rafters arranged in inclined substantially uniformly spaced apart relation and provided with a plurality of opposed recess means therein at uniformly spaced apart intervals therealong and a plurality of purlins extending therebetween with the ends thereof projecting into and fully registered within said opposed recess means of said rafters so as to intersect therewith and be supported therefrom, each said purlins and rafters including longitudinally extending open ended drainage channel means therein and opening upwardly longitudinally centrally therealong, said drainage channel means being defined by a bottom wall upstanding spaced apart outer side walls and flange means extending inwardly from said outer side walls and in spaced apart opposed overlying relation to said bottom wall, each said recess means of said rafters having a perimetral extent within said side walls and flanges means thereof and the respective depths of the channel means of said purlins and rafters being such that in full registration said intersecting flange means of said purlins and rafters are disposed in substantially coplanar relation and water collected in the channel means of said purlins is discharged therefrom downwardly into the channel means of said rafters at a point inwardly spaced form the side walls of said rafters and connecting means carried by said purlins at the ends thereof for engagement with said channel means of said rafters for securing said purlins and rafters against separation.

2. A roof structure according to claim 1 wherein said connecting means for securing said rafters and purlins against separation includes clip means disposed within the channel means of said rafters, said clip means having a configuration so matching the perimeter of said recess means therein as to embracingly engage said ends of said purlins projecting thereinto from below, said clip means extending beyond said recess means to engage said flange means of said rafters from below upon upward displacement thereof into embracing engagement with the ends of said purlins, and means carried by said ends of said purlins for displacing said clip means upwardly thereagainst and into engagement with said flange means of said rafters to thereby secure same against separation.

3. A roof structure according to claim 2 wherein the surfaces of said clip means and recess means presented to the surfaces of said ends of said purlins when fully registered therein and secured aainst separation are joined thereover by resilient bonding means substantially impervious to the atmosphere and to water.

4. A roof structure according to claims 1, 2 or 3 wherein each said rafter and purlin includes anchoring means upstanding from the bottom walls thereof and between said opposed flange means thereof and means overlying said flange means and said anchoring means and operatively engageable with said anchoring means whereby panel means to be supported upon said flange means thereof are secured thereto against separation.

5. A roof structure according to claim 4 wherein said means overlying said flange means and said anchoring means and operatively engageable with said anchoring means comprises elongated plate means and screw threaded means carried by same centrally thereof, said screw threaded means being engageable in said anchoring means to draw said elongated plate means downwardly to engage over the edges of panel means to be supported upon said opposed flange means of said rafters and purlins.

6. A roof structure according to claim 5 wherein said elongated plate means includes resiliently compressible sealing means along the opposed edges thereof and projecting therebelow, whereby under forces of compression applied thereto and against the edges of panel means to be supported upon said opposed flange means a seal substantially impervious to the penetration of atmosphere and water is established.

7. In a building system wherein a plurality of elongated structural members are arranged and interconnected in angled relation to one another and present a substantially rigid rectilinear flange formation to the edges of panel means to be supported thereupon, said structural members including open ended drainage channel formations therein extending perimetrally of said flange formation and therebelow and outwardly therebeyond whereby drainage thereinto from above can be channeled therealong and discharged therefrom, the ends of the drainage channel formations of said structural members arranged in one common direction intersecting and overlapping the drainage channel means of said structural members arranged in the other common direction so as to be supported therefrom and to the extent that water collected therein is discharged into the drainage channel formation of said supporting structural members at a point remote from the intersections thereof.

8. A system according to claim 7 wherein at least some of said structural members present opposed perimetrally extending flange formations which flank said drainage channel formations therein whereby more than one panel means can be supported thereupon from their edges in side by side relation.

9. A system according to claim 7 wherein each said structural members include anchoring means upstanding therefrom in the region of said channel formations outwardly beyond said flange formations and means engageable with said anchoring means for securing against separation panel means to be supported thereupon from its edges.

10. A system according to claims 7, 8 or 9 wherein said structural members are interconnected at their intersections by displaceable clamping means including means embracing from below each such drainage channel formation of said supporting structural member in the region overlapping the drainage channel formation of the supporting structural member, said embracing means extending therebeyond and into engagement with the flange formation of said supporting structural members from below.

11. In a building system wherein a first elongated structural member is adapted to support a second elongated structural member therefrom and each such structural member includes a longitudinally extending open ended channel means therein defined by a bottom wall, upstanding spaced apart side walls and flange means extending inwardly from at least one of said side walls in overlying spaced relation above said bottom wall, said first structural member including recess means within said side wall and associated flange means and spaced upwardly from the bottom wall thereof, and having a configuration to receive therein one open end of said second structural member in overlapping relation to said first structural member and in full registration therewith so as to be supported therefrom above said bottom wall thereof, means for securing said second structural member to said first structural member including clip means disposed within the channel means of said first structural member, said clip means having a configuration so matching the perimeter of said recess means therein and said overlapping end of said second structural member as to embracingly engage same from below, said clip means including extensions projecting beyond said recess means to engage said flange means of said first structural member from below upon upward displacement thereof into embracing engagement with said overlapping end of said second structural member, and means carried by said overlapping ends of said second structural member for drawing said clip means upwardly thereagainst and said projecting extensions into engagement with said flange means of said first structural member.

12. A building system according to claim 11 wherein said clip means includes platform means bounded by upstanding spaced apart wall means extending inwardly form said recess means of said first structural member below and flanking respectively said overlapping end of said second structural member and screw threaded means carried by said overlapping end of said second structural member engageable with said platform means to draw same upwardly thereagainst and into engagement with said flange means of said first structural member.

13. A building system according to claim 12 wherein the surfaces of said clip means and said recess means presented to the surfaces of said overlapping end of said second structural member, when fully registered therein and secured against separation are joined thereover by resilient bonding means substantially impervious to the atmosphere and to water.

14. A building system according to claims 11, 12 or 13 wherein said recess means of said first structural member has a perimetral extent within said side wall and associated flange means thereof and the respective depths of the channel means thereof are such that in full registration said flange means intersect and are disposed in substantially coplanar relation.

* * * * *